United States Patent [19]

Stark et al.

[11] Patent Number: 4,503,672

[45] Date of Patent: Mar. 12, 1985

[54] DIESEL EXHAUST CLEANER WITH GLOW PLUG IGNITERS AND FLOW LIMITING VALVE

[75] Inventors: Terrence L. Stark, Washington; Otto A. Ludecke, Rochester, both of Mich.

[73] Assignee: General Motors Corporation, Detroit, Mich.

[21] Appl. No.: 555,055

[22] Filed: Nov. 25, 1983

[51] Int. Cl.[3] ..... F01N 3/02

[52] U.S. Cl. ..... 60/286; 55/466; 55/DIG. 10; 55/DIG. 30; 60/288; 60/296; 60/303; 60/311

[58] Field of Search ..... 60/288, 295, 296, 303, 60/300, 311, 286; 55/466, DIG. 10, DIG. 30

[56] References Cited

U.S. PATENT DOCUMENTS 4,345,431 8/1982 Suzuki ..... 55/283

4,386,497 6/1983 Takagi ..... 60/311

4,404,795 9/1983 Oishi ..... 55/466

4,427,418 1/1984 Kogiso ..... 55/523

*Primary Examiner*—Douglas Hart

*Attorney, Agent, or Firm*—Arthur N. Krein

[57] ABSTRACT

An exhaust cleaner system for use in the exhaust system of a diesel engine is provided with a particulate filter positioned in a trap housing with an exhaust inlet thereto and an exhaust outlet therefrom. A pair of exhaust ducts are positioned in the inlet end of the exhaust outlet whereby to define, in effect, three separate exhaust flow zones through the filter and a flow limiter valve is operatively positioned to sequentially control flow through the exhaust ducts. Glow plugs are located so as to extend into the zones of the filter associated with the exhaust ducts to initiate incineration of particulates during reduced exhaust flow conditions as controlled by the flow limiter valve.

3 Claims, 3 Drawing Figures

DIESEL EXHAUST CLEANER WITH GLOW PLUG IGNITERS AND FLOW LIMITING VALVE

BACKGROUND OF THE INVENTION

This invention relates to diesel engine exhaust treatment systems, and, in particular, to an exhaust cleaner with glow plug igniters and flow limiting valve for use in collecting and then incinerating particulates discharged with the exhaust gases from a diesel engine.

BACKGROUND OF THE INVENTION

Considerable interest has recently been focused on the problem of limiting the mass of particulate matter emitted with the exhaust gases from diesel and other internal combustion engines. In the case of diesel engines, a great deal of effort is currently being expended to develop practical and efficient devices and methods for reducing emission of particulates in exhaust gases.

One method for accomplishing this is to provide a suitable particulate trap in the exhaust system of a diesel engine, the trap having at least one filter positioned therein which is capable of efficiently trapping the particulates from the exhaust gases and which is also adapted to be regenerated as by the in-place incineration of the trapped particulates collected thereby.

A ceramic wall-flow monolith particulate filter of the type disclosed, for example, in U.S. Pat. No. 4,364,761 entitled "Ceramic Filters For Diesel Exhaust Particulates and Methods of Making", issued Dec. 21, 1982 to Morris Berg, Carl F. Schaefer and William J. Johnston, has emerged as a preferred form of such a filter device.

Such a ceramic wall-flow monolith particulate filter includes an outer wall interconnected by a large number of interlaced, thin porous internal walls which define a honeycomb structure to provide parallel channels running the length thereof. Alternate cell channel openings on the monolith face are blocked and, at the opposite end the alternate channel openings are blocked in a similar manner but displaced by one cell whereby to define inlet channels and outlet channels.

With this filter arrangement, the exhaust gas cannot flow directly through a given inlet channel but is forced to flow through the separating porous walls into an adjacent outlet channel. The exhaust gas is thus filtered as it flows through the porous walls between adjacent channels.

As this type ceramic filter is presently manufactured, the ceramic walls thereof are fabricated by extrusion and then fired. After firing, the alternate channel openings are suitably sealed, as by being plugged with a non-porous material, to provide the structure described hereinabove with a plurality of inlet channels and a plurality of outlet channels arranged in checkerboard fashion.

Such a ceramic filter device is suitably located in the engine exhaust system of a vehicle so as to remove particulates from the exhaust gases by trapping of the particulates on the walls of the inlet passages or channels separating them from their associate adjacent outlet channels.

The filter will, with use, then become clogged with the carboneous material. The diesel particulates will increase the backpressure in the exhaust system of the diesel engine. It is thus necessary to remove the diesel particulates from the filter from time to time to prevent the deleterious effect on engine performance due to high backpressure.

The carboneous particulates, thus collected, can be removed from the filter by raising the temperature of the inlet gas to the particulate ignition temperature to effect incineration thereof. The carboneous particulate when produced from normal diesel fuel, that is, D-2 diesel fuel, will ignite if the temperature is raised to approximately 600° C. in the presence of 15% -18% oxygen.

However, as is well known, a diesel engine achieves exhaust temperatures of this magnitude only under very severe engine loading conditions. Therefore, a supplementary source of heat to rise the exhaust inlet temperature to the wall flow ceramic filter is normally necessary. This usually requires the use of a relatively costly heat source, such as a fuel burner or an electrice resistance heater, in series with the exhaust flow to raise the temperature of the gases to approximately 600° C.

It is also known in the art, that fuel additives, such as copper napthtenate, copper acetate, tetraethyl lead and manganese (MMT), in the diesel fuel will reduce the ignition temperature of diesel particulates to approximately 320° C.–420° C. The quantity of the additive content in the fuel has normally been from about 0.05 gm/gal to 0.75 gm/gal to effect this desired reduction of ignition temperature of the particulates.

It is also known that the particulates, from such treated diesel fuel, that are deposited on a fairly low heat conductive surface, whether it is metallic in nature or ceramic, can be ignited in a small area by glowing engine sparks, electric arc or heater, or a small pin point torch type fuel burner. After ignition, the particulate (using the above described metallic additives in the fuel) burning will readily propagate over those surfaces of the filter on which the particulates have been deposited.

As described above, the fuel additive normally will reduce the ignition temperature of the particulates to as low as 320° C. depending on the additive and concentration used. In addition, the burning of a small portion of the particulate causes continuous layers to ignite and the combustion propagates. It is presumed that the metallic additive after having been exposed to the engine combustion process is throughly oxidized. These oxidized metallic particulates are throughly dispersed in the carboneous particulates. When the temperature of this dispersion is locally raised in temperature, then an exothermic reaction occurs. The oxygen molecules in the metal oxide freely combines with the carbon to form CO and $CO_2$. The reaction produces a large quantity of energy and increased gas temperature which causes continuous ignition of the surrounding layers of the metal oxide-carbon dispersion.

When a wall flow ceramic monolith filter is to be regenerated, it is thus desirable, from a cost standpoint, to ignite only small areas on the filter.

SUMMARY OF THE INVENTION

Accordingly, a primary object of the invention is to provide an improved exhaust cleaner with glow plug igniters and flow limiting valve for use with a diesel engine that advantageously utilizes a flow limiting valve arrangement to reduce exhaust flow through a portion of a filter and glow plugs projecting into the filter to initiate the incineration of particulates collected on the filter.

Another object of the invention is to provide an improved exhaust cleaner with glow plug igniters and flow limiting valve system for a diesel engine of the type wherein a ceramic wall-flow particulate trap is used to collect particulates and glow plugs embedded into the trap are used to effect incineration of the particulates collected by the filter and wherein a flow limiting valve is used to reduce exhaust flow through the portion of the filter in which the plugs are located during initial ignition of the particulates.

For a better understanding of the invention, as well as other objects and further features thereof, reference is had to the following detailed description of the invention to be read in connection with the accompanying drawings.

DESCRIPTION OF A PREFERRED EMBODIMENT

Figure 1:
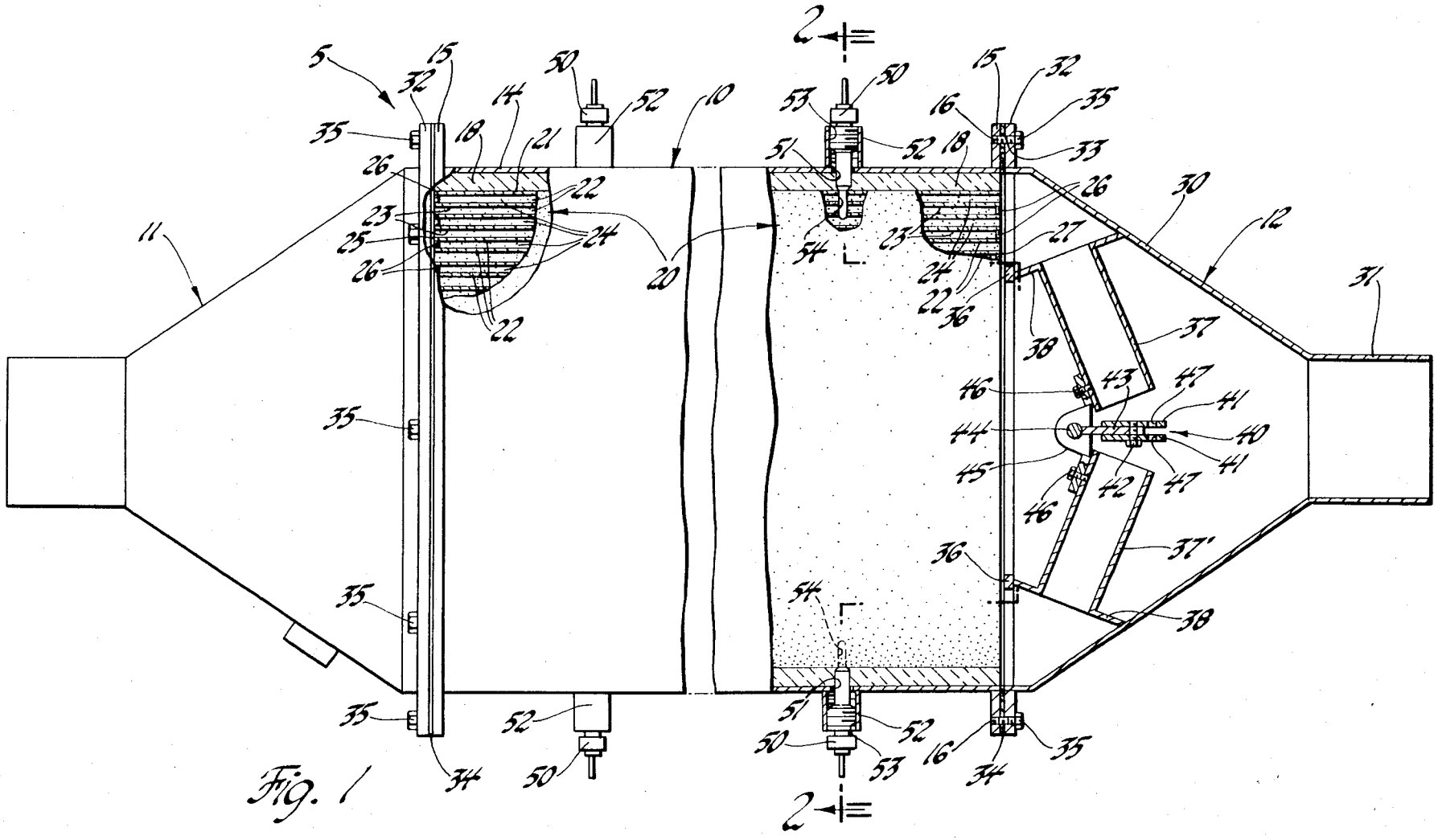
FIG. 1 is a schematic view, with parts broken away, of a diesel exhaust cleaner with glow plug igniters and flow limiting valve system in accordance with a preferred embodiment of the invention.

Referring now to FIG. 1 there is illustrated a single path exhaust cleaner with glow plug igniters and flow limiting valve system in accordance with the invention for use with a diesel engine.

The exhaust cleaner, generally designated 5, in the construction shown, is provided with a tubular trap housing that includes a filter housing 10 having a conventional exhaust inlet 11 at one end and an exhaust outlet 12 at its opposite end.

In the construction shown, the filter housing 10 includes an outer shell 14 that is suitably fixed, as by welding, at its opposite ends to a pair of ring-like flanges 15. Each flange 15 is provided with circumferentially spaced apart, internally threaded apertures 16, only the apertures 16 in the flange 15 at the exhaust end of the filter housing being shown, whereby the exhaust inlet and outlet can be secured to the trap housing.

A ceramic wall-flow monolith particulate filter 20, of the type shown, for example, in the above-identified U.S. Pat. No. 4,364,761, is suitably supported as by a suitable high temperature resistant material 18 in a known manner within the shell 14 of the filter housing 10.

Figure 2:
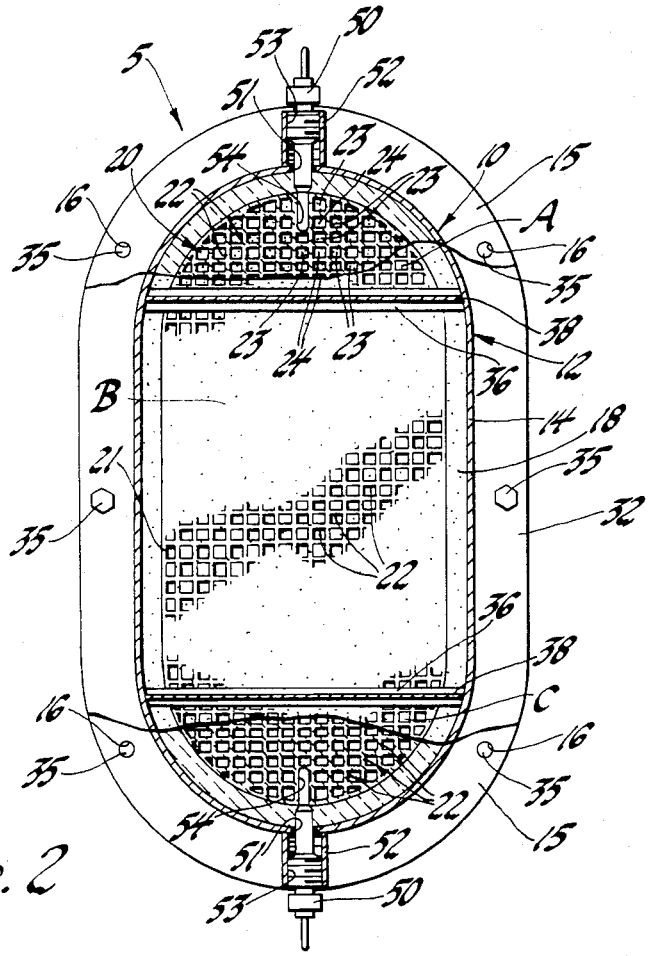
FIG. 2 is an enlarged sectional view of the filter outlet end of the system of FIG. 1 taken along line 2—2 of FIG. 2, the channels of the filter being substantially enlarged for purposes of illustration only; and, FIG. 3 is a schematic diagram of the system of FIG. 1 with control circuit.

As shown in FIGS. 1 and 2, the filter 20 is provided, in the construction illustrated, with a surrounding oval outer wall 21 internally interconnected by a large number of interlaced thin porous internal walls 22. The interlaced walls 22 define internally thereof two groups of parallel passages or channels including respectively, inlet channels 23 and outlet channels 24, each extending to opposite ends of the filter element 20. The inlet channels 23 are open at the inlet end 25 of the element and are closed by plugs 26 at the outlet end 27 of the element, while the outlet channels 24 are closed by nonporous plugs 26 at the element inlet end 25 and open at the outlet end 27.

In the construction shown, the channels are of square cross-section as best seen in FIG. 2, although, as disclosed in the above-identified U.S. Pat. No. 4,364,761, numerous other configurations could be utilized. Further, the inlet and outlet channels 23 and 24, respectively, are arranged in vertical and horizontal rows (as viewed in cross-section), with the inlet channels 23 alternating with exhaust channels 24 in a checkerboard pattern. Thus, it will be appreciated that each interior wall 22 portion of the filter lies between an inlet channel and an outlet channel at every point of its surface except where it engages another wall, as it does at the corners of the channels. So, except for the corner engagement, the inlet channels 23 are spaced from one another by intervening outlet channels 24 and vice versa.

The construction of the ceramic monolith is such that the interior walls 22 are porous so as to permit passage of exhaust gases through the walls from the inlet to the outlet channels. The porosity of the walls is sized appropriately to filter out a substantial portion of the particulates present in diesel exhaust gases.

Preferably the filter 20, as best seen in FIG. 2, is of oval configuration and the shell 14 is of similar configuration for a purpose to be described hereinafter.

Referring now to the exhaust outlet 12, in the construction shown, this exhaust outlet starting from the left with reference to FIG. 1, includes a transition member 30 having an inlet end portion corresponding substantially in size and shape to that of shell 14 and an outlet member 31. The transition member 30 has its inlet end portion suitable secured, as by welding, to an oval ring like mounting flange 32 having spaced apart screw receiving apertures 33 therethrough. The exhaust outlet is secured to the flange 15 at the discharge end of the filter housing 10, with a heat resistant gasket 34 sandwiched therebetween, by screws 35 which extend through apertures 33 into threaded engagement in the apertures 16.

Now in accordance with a feature of the invention, exhaust flow into the exhaust outlet 12 and thus in effect, exhaust flow through the filter 20 is subdivided into three flow zones A, B and C, as shown in FIG. 2, for a purpose to be described in detail hereinafter.

For the purpose of defining these flow zones, a pair of cross braces 36 are suitably secured, as by welding, to the flange 32 so as to extend transversely across the opening therethrough in spaced apart relationship to each other as best seen in FIG. 2.

In addition, a pair of T-shaped exhaust ducts 37 and 37' are located in the transition member 30 at an inclined angle relative to the longitudinal axis of the exhaust outlet 12 so that their axes intersect on the longitudinal axis of the exhaust outlet 12. Each exhaust duct is suitably secured as by having the arcuate portion of its flanged base 38 welded to the interior wall of the transition member 30 and the straight portion of its flanged base welded to an associate brace 36. As thus secured, the outlet ends of these exhaust ducts are spaced apart a predetermined distance and the axis of these ducts intersect on the longitudinal axis of the exhaust outlet 12.

Flow through the exhaust ducts 37 and 37' is controlled by a flow limiting valve, generally designated 40, that is pivotally mounted between the outlet ends of the exhaust ducts 37 and 37'.

As shown in FIG. 1, the flow limiting valve 40 includes a pair of valve discs 41 secured as by a screw 42 to opposite sides of one end of a valve lever 43. The opposite end of the valve lever 43 is suitably secured, as by welding, to one end of an actuator rod 44 that is rotatably journaled in a suitable support bracket 45 fixed as by screws 46 to the exhaust ducts 37 and 37'. The opposite end of the actuator rod 44 sealingly extends through a suitable aperture provided for this purpose in the transition member 30 whereby it can be connected to a suitable valve actuator, such as vacuum motor MOT-1, as shown in FIG. 3.

As best seen in FIG. 1, the axes of the actuator rod 44 extend at right angles to the axis of the exhaust outlet whereby when the flow limiting valve is in its neutral open position, it lies substantially midway between the opposed outlet ends of the exhaust ducts 37 and 37'.

Figure 3:
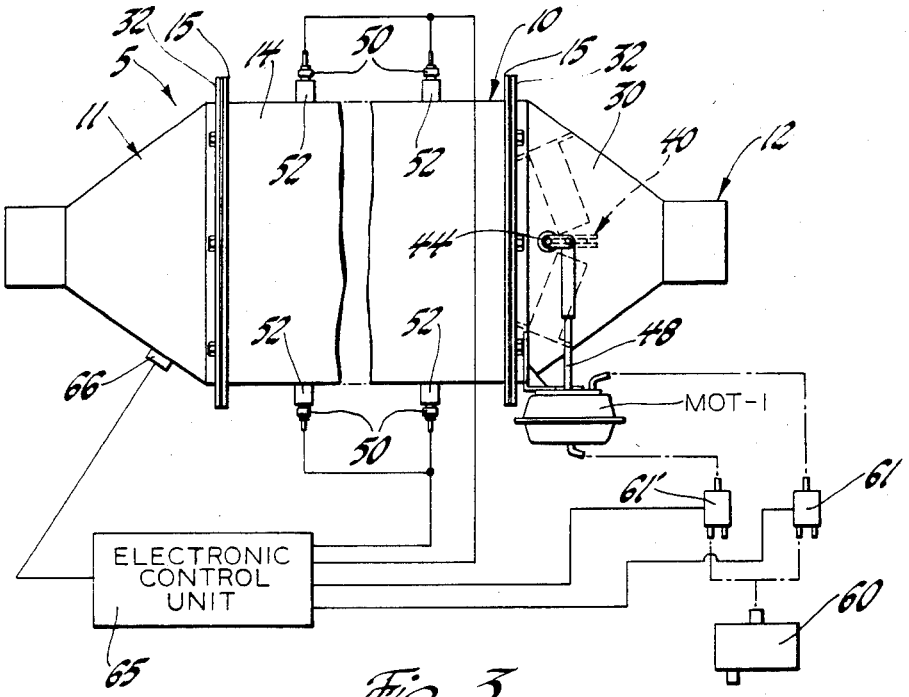

As shown in FIG. 3, the vacuum motor MOT-1 is coupled to the actuator rod 44 by means of an arm 48 whereby the valve 40 is normally open, that is in the open position shown in FIG. 1, whereby exhaust gases can flow through the three zones A, B and C of the filter 20, and whereby this valve can then be sequentially moved into and out of seating engagement with the exhaust ducts 37 and 37'.

Preferably, as shown, each valve disc 41 is provided with an aperture 47 therethrough of predetermined flow area whereby when the valve 40 is positioned so that a valve disc 41 seats, for example, against the outlet of exhaust duct 37 a small volume of exhaust gas can flow through the associate zone A.

In a particular application, the apertures 47 were sized so that the flow area thus provided together with leakage flow through the clearance space existing between the outlet end 27 of the filter 20 and the adjacent cross brace 36 was such that the exhaust flow through either zone A or zone C was limited to about 1 CFM or less.

Now in accordance with another feature of the invention, incineration of the particulates collected on the filter 20 is initiated by means of suitable electric igniters such as glow plugs 50. The glow plugs 50 are located so that at least one such glow plug igniter projects radially into each of the flow zones A and C of the filter 20.

For this purpose in the embodiment shown, the outer shell 14 of the filter housing 10 is provided on opposite arcuate sides thereof with axially spaced apart apertures 51 of a suitable size to slidably receive the sheath of an associate glow plug 50. Each aperture 51 is encircled by a tubular plug retainer 52 that is secured, as by welding, to the exterior of the outer shell 14. Each plug retainer 52 is provided with internal threads 53 to threadingly receive the externally threaded metal outer shell of an associate glow plug 50.

As best seen in FIG. 2, the filter 20 is provided, as by drilling, with blind bores 54 of predetermined size and depth so as to receive the sheath of an associate glow plug 50, each such blind bore 54 being substantially axially aligned with an associated aperture 51 and plug retainer 52.

Although the glow plug 50 may be of any suitable type, they are preferably dual coil self limiting glow plugs of the type disclosed in copending U.S. patent application Ser. No. 392,600 entitled Quick Heat Self Regulating Electric Glow Heater filed June 28, 1982 in the names of Michael P. Murphy, Gary F. Stack, James W. Hoppenrath and John R. Taylor and assigned to a common assignee. This type glow plug as presently manufactured has an exposed sheath length of slightly less than one inch, that is, an actual exposed length of 23.75 to 25.25 mm.

Accordingly, since a ceramic wall-flow monolith particulate filter, such as filter 20 can have up to 200 cells or channels per inch square of filter cross section, it will be appreciated that in a normal filter embodiment, a blind bore 54, and therefore the sheath of an associate glow plug 50, will intersect a relatively large number of channels, about half of which will be inlet channels 23, which during operation will be collecting particulates on the internal walls 22 separating these inlet channels 23 from adjacent outlet channels 24.

Thus, with reference to FIG. 2, one set of glow plugs 50 extends through the material 18 into the flow path through upper zone A while the other set of glow plugs 50 extends in a similar manner through the material 18 into the flow path through lower zone C. Although in the construction illustrated the glow plugs 50 are located so that their axes lie, as shown in FIG. 2, in a common vertical plane that extends through the longitudinal central axis of the trap housing, the glow plugs of each set could be located on opposite sides of this plane, it only being preferred that the glow plugs of each set extends into an associated flow zone A or C.

Referring now to the system diagram shown in FIG. 3, in the embodiment illustrated, each chamber on opposite ends of the vacuum motor MOT-1 is connected to a source of vacuum, such as vacuum can 60 by suitable conventional solenoid valves 61 and 61' of the type which when deenergized will place the associate chamber in flow communication with the atmosphere and when energized will place that chamber in flow communication with the source of vacuum. A spring means, not shown, in the vacuum motor MOT-1 is operatively positioned to maintain the diaphragm, not shown, in the vacuum motor MOT-1, and thus the flow limiting valve 40, in a neutral position, the position of the valve 40 shown in FIG. 1, whereby exhaust gases can flow freely through the three flow zones A, B and C.

Preferably and as schematically shown in FIG. 3, each set of glow plugs 50 and the solenoid valves 61 and 61' are suitably connected to a source of electrical power as controlled by means of an electronic control unit 65, such as an onboard computer, in a manner well known in the art.

For this purpose, the electronic control unit 65 would, in a conventional manner, receive input signals of various engine operating conditions and, in addition, it would preferably also receive suitable signals by means of a pressure transducer 66 indicating the pressure differential existing across the particulate filter 20 during engine operation.

By way of an example, in a particular engine application supplied with fuel containing an additive, the electronic control unit 65 was programmed so that during engine operation, when the particulate filter 20 was loaded with particulates and fuel additive deposits to a predetermined exhaust backpressure level, the solenoid valve 61 is energized whereby to effect operation of the vacuum motor MOT-1 so as to move the flow limiting valve 40 against the outlet end of the exhaust duct 37 to limit exhaust flow down to 1 CFM or less through the flow zone A. At the same time, the set of glow plugs 50, associated with the flow zone A of the filter 20, are energized for approximately one minute whereby to ignite the particulates in the local areas in the zone A portion of the filter 20 surrounding these glow plugs 50 under low exhaust flow conditions.

Thereafter, after a time interval of about two minutes, the solenoid valve 61 is deenergized and solenoid valve 61' is energized whereby to effect operation of the vacuum motor MOT-1 so as to move the flow limiting valve 40 from the outlet end of exhaust duct 37, thus allowing full exhaust flow through flow zone A, to the outlet end of exhaust duct 37' whereby to thus limit exhaust flow through flow zone C in a similar manner as described hereinabove. At the same time, the set of glow plugs 50 associated with the flow zone C of the filter 20 are energized for approximately one minute to then ignite the particulates in the local areas in the zone C portion of the filter 20 surrounding these glow plugs under low exhaust flow conditions.

Again, after another time interval of about two minutes, the solenoid valve 61' is deenergized. This then allows the vacuum motor MOT-1 via the associate spring therein, not shown, to move the flow limiting valve 40 to its normally open position, the position shown in FIG. 1, to again allow full exhaust flow through flow zone C.

With the particulates ignited in both flow zones A and C, flame propagation will occur in these zones and the heat of combustion in these zones will then initiate combustion of the particulates in the central flow zone B so that the entire filter 20 will then be regenerated.

While the invention has been described with reference to the structure disclosed herein, it is not confined to the specific details set forth, since it is apparent that various modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. An exhaust cleaner and particulate igniter system for use with a diesel engine, said system including a housing having an inlet at one end for receiving exhaust flow from an engine and an exhaust outlet at its opposite end; a particulate filter means operatively positioned in said housing intermediate said inlet and said exhaust outlet and having an inlet face adjacent to said inlet and an outlet face next adjacent to said exhaust outlet; first and second secondary exhaust outlet ducts operatively positioned in said exhaust outlet with their inlet ends positioned next adjacent to opposite outboard zones of said outlet face and with their outlet ends located in the exhaust flow path through said exhaust outlet; a normally open, exhaust flow limiter valve means operatively positioned between said outlet ends of said outlet ducts and being movable so as to selectively block flow through said outlet ends; electrical igniter means operatively supported by said housing on opposite outboard sides thereof intermediate said inlet face and said outlet face of said filter means, said electrical igniter means extending into said opposite outboard zones of said particulate filter means as defined by said outlet ducts; and, control means operatively connected to said valve means and to said electrical igniter means whereby said valve means can be moved to sequentially block flow through one of said outlet ends so as to substantially block exhaust flow through the associate one of said outboard zones and, at the same time to energize said igniter means associated with the associate said outboard zone whereby to ignite particulates trapped in the associate said outboard zone of said particulate filter.

2. An exhaust cleaner and particulate igniter system for use with a diesel engine, said system including a housing having an inlet at one end for receiving exhaust flow from an engine and an exhaust outlet at its opposite end; a particulate filter means operatively positioned in said housing intermediate said inlet and said exhaust outlet and having an outlet face next adjacent to said exhaust outlet; first and second secondary exhaust outlet duct means operatively positioned in said exhaust outlet with their inlet ends positioned next adjacent to opposite outboard portions of said outlet face and with their outlet ends located in the exhaust flow path through said exhaust outlet whereby to divide flow through said filter into three flow zones; a normally open, exhaust flow limiter valve means operatively positioned to selectively block flow through said exhaust outlet duct means; electrical igniter means operatively supported by said housing on opposite outboard sides thereof, with said electrical igniter means extending into said opposite outboard portions of said particulate filter means intermediate said inlet face and said outlet face thereof; and, control means operatively connected to said valve means and to said electrical igniter means whereby said valve means can be moved to sequentially block flow through one of said exhaust outlet duct means so as to substantially block exhaust flow through the associate one of said flow zones and, at the same time to energize said igniter means associated with the associate said flow zone whereby to ignite particulates trapped in the associate said flow zone of said particulate filter.

3. An exhaust cleaner and particulate igniter system for use with a diesel engine, said system including a housing having an inlet at one end for receiving exhaust flow from an engine and an exhaust outlet at its opposite end; a wall flow particulate filter means operatively positioned in said housing intermediate said inlet and said exhaust outlet and having an outlet face next adjacent to said exhaust outlet; said exhaust outlet having first and second secondary exhaust duct means therein to divide the inlet end of said exhaust outlet into three flow zones; a normally open, flow limiter valve means operatively positioned between said exhaust duct means and being movable so as to selectively block flow through said exhaust duct means; electrical igniter means operatively positioned to extend into the portions of said filter means operatively associated with said exhaust duct means; and, control means operatively connected to said valve means and to said electrical igniter means whereby said valve means can be moved to sequentially block flow through said exhaust duct means and to energize said igniter means in the portions of said filter means associated with said exhaust duct means whereby particulates can be ignited in said portions of said filter means while exhaust flow therethrough is restricted.

* * * * *